United States Patent [19]

Ohashi et al.

[11] 4,330,617

[45] May 18, 1982

[54] PHOTOGRAPHIC ELEMENTS CONTAINING NOVEL DEVELOPING AGENT PRECURSORS

[75] Inventors: Minoru Ohashi; Katsuaki Iwaosa, both of Nagaokakyo, Japan

[73] Assignee: Mitsubishi Paper Mills, Ltd., Tokyo, Japan

[21] Appl. No.: 231,444

[22] Filed: Feb. 4, 1981

[30] Foreign Application Priority Data

Feb. 5, 1980 [JP] Japan ..... 55/12809

[51] Int. Cl.[3] ..... G03C 5/30

[52] U.S. Cl. ..... 430/405; 430/441; 430/443; 430/566; 430/959

[58] Field of Search ..... 430/959, 566, 493, 405, 430/441, 448, 443, 438, 485, 264, 249

[56] References Cited

U.S. PATENT DOCUMENTS

| | | | |
|---|---|---|---|
| 3,246,988 | 4/1966 | Porter | 430/493 |
| 3,311,476 | 3/1967 | Loria | 430/555 |
| 3,577,236 | 5/1971 | Fix | 430/959 |
| 3,765,897 | 10/1973 | Nittel | 430/546 |
| 4,201,578 | 5/1980 | Abbott | 430/566 |

*Primary Examiner*—Mary F. Downey

*Attorney, Agent, or Firm*—Cushman, Darby & Cushman

[57] ABSTRACT

The compounds represented by the general formula (I) or (II) as defined in the specification are novel and useful developing agent precursors in silver halide photographic light sensitive materials.

16 Claims, No Drawings

PHOTOGRAPHIC ELEMENTS CONTAINING NOVEL DEVELOPING AGENT PRECURSORS

BACKGROUND OF THE INVENTION

This invention relates to silver halide photographic light sensitive materials which contain developing agent precursors.

It is known to use silver halide developing agents for processing silver halide emulsions.

It is also known to incorporate silver halide developing agents into layers of photographic elements having layers of light sensitive silver salts.

Usually, such emulsions, after exposure, are developed by processing them with developing activators such as alkaline solution. This alkaline solution may contain developing agents.

After development by either one of these methods, silver images developed are fixed or stabilized with usual fixing baths such as sodium thiosulfate or thiocyanate baths.

Thus developed and fixed silver halide emulsion layer is then washed with water and dried.

It is convenient to add the developing agent to at least one layer of photographic elements. However, sometimes this is unfavorable because the content of the developing agent decreases during storage due to diffusion, sublimation, etc. Furthermore, developing agents are oxidized even over a relatively short storage to decrease their effects and besides produce colored oxidation products, which cause undesired stains.

One of the methods proposed for overcoming these defects is to add the so-called developing agent precursors to one of the layers of photographic elements.

These developing agent precursors are compounds which do not have developing action before development is carried out and which liberate silver halide developing agents only when they are allowed to contact with appropriate activators.

For example, U.S. Pat. No. 3,295,978 discloses inorganic salts of developing agents (such as lead, calcium, cadmium, barium, etc.), U.S. Pat. No. 3,246,988 discloses halogenated acyl derivatives of hydroquinone, U.S. Pat. No. 3,462,266 discloses oxazine or bisoxazine derivatives of hydroquinone, Japanese Patent Publication (Kokoku) No. 28330/72 discloses aliphatic acyl derivatives of hydroquinone which have quaternary ammonium substituents, and Japanese Patent Publistion (Kokoku) No. 33379/72 discloses lactone type precursors. However, these conventional developing agent precursors are not necessarily satisfactory, namely, some of them do not produce desired developing agents within appropriate periods, have adverse effects on development, are poor in solubility and so substantially are difficult to add to layers of photographic elements, are very difficult to prepare and low in utility, gradually decompose during storage to produce developing agents which become oxidation products upon oxidation to cause undesired stains.

Therefore, those developing agent precursors which cause little staining and keep or provide good photographic speed and desired sensitometries such as density and others have been demanded in this technical field.

SUMMARY OF THE INVENTION

As a result of the inventors' intensive research of developing agent precursors which fully meet the demands, it has been found that these demands can be attained by containing the developing agent precursors represented by the following general formula (I) and/or general formula (II) in emulsion layer and/or other water permeable colloid layers in photographic elements which comprise a support and at least one silver halide emulsion layer.

That is, the developing agent precursors according to this invention have the following characteristics: They have higher water solubility than unsubstituted esters or halogenated esters of developing agents (e.g., catechol, hydroquinone, etc.) because they have carboxyl group at the proper position; Preparation of them is very simple; They are very quickly hydrolyzed in the presence of alkaline aqueous solution to liberate corresponding developing agents and thus provide good photographic speed; and they are not hydrolyzed in acidic aqueous solution and so cause little undesired staining during storage.

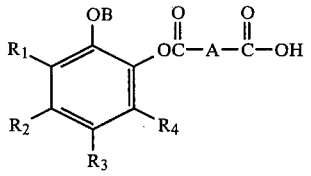

(I)

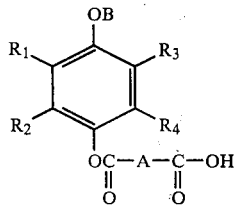

(II)

[wherein $R_1$, $R_2$, $R_3$ and $R_4$ represent hydrogen atom, alkyl group (preferably that of 1–10 carbon atoms), substituted or unsubstituted phenyl group, halogen atom or alkoxy group (preferably that of 1–5 carbon atoms), A represents divalent residue represented by the following general formula (III) or (IV):

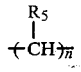

(III)

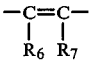

(IV)

(wherein n represents 2 or 3, $R_5$ represents hydrogen atom, an alkyl group (preferably that of 1–5 carbon atoms), a substituted or unsubstituted phenyl group, a halogen atom or an alkoxy group (preferably that of 1–5 carbon atoms), $R_6$ and $R_7$ represent hydrogen atom, halogen atom, alkyl group (preferably that of 1–5 carbon atoms) or substituted or unsubstituted phenyl group, $R_6$ and $R_7$ taken together may form a benzene ring which may be substituted with carboxyl group, nitro group, halogen atom, alkyl group of 1–5 carbon atoms and the like) and B represents hydrogen atom or

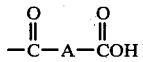

(wherein A represents the same divalent residue as mentioned above)].

DESCRIPTION OF THE INVENTION

Listed below are typical examples of the developing agent precursors according to this invention which come within the scope of the above general formulas, but they never limit this invention.

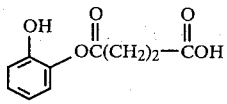

Compound 1

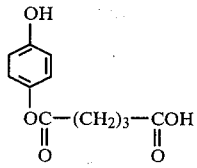

Compound 2

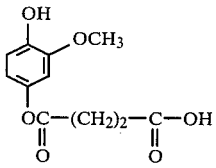

Compound 3

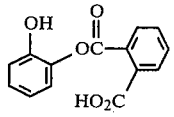

Compound 4

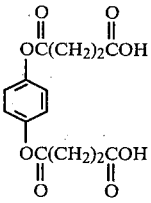

Compound 5

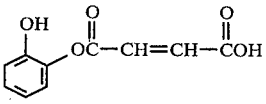

Compound 6

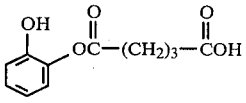

Compound 7

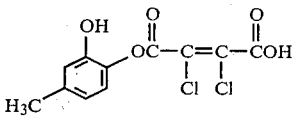

Compound 8

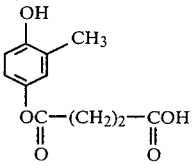

Compound 9

-continued

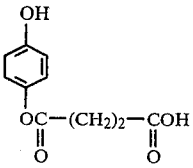

Compound 10

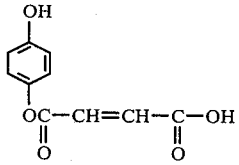

Compound 11

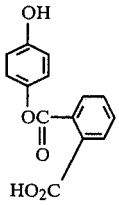

Compound 12

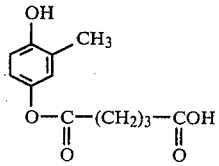

Compound 13

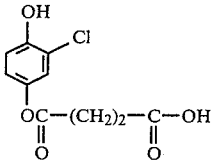

Compound 14

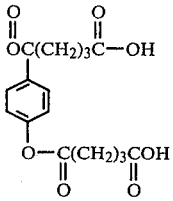

Compound 15

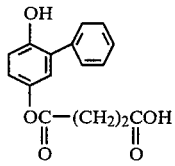

Compound 16

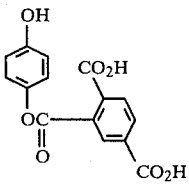

Compound 17

-continued

Compound 18

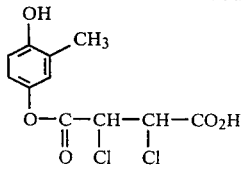

As is clear from the following examples of preparation, these compounds represented by the general formula (I) or (II) may be easily obtained by acting an alkali (e.g., triethylamine) on a developing agent (e.g., hydroquinone) and an acid anhydride (which can be easily prepared from the corresponding dicarboxylic acid).

Examples of preparation of developing agent precursors according to this invention will now be shown below.

Example of Preparation 1

(Compound 1)

5.5 gr of catechol and 5.5 gr of succinic anhydride were dissolved in 50 ml of dixoane and then 5.6 gr of triethylamine was dropped thereto little by little through a dropping funnel with stirring.

The solution was stirred for about one hour at room temperature and then the solvent was distilled off under reduced pressure. To the residue was added 20 ml of water to dissolve it and then the solution was neutralized with hydrochloric acid and thereafter was subjected to extraction with ethyl acetate. The layer of ethyl acetate was dried with $Na_2SO_4$ and the solvent was distilled off to separate the crystals.

These crystals were recrystallized from benzene-ethyl acetate.

Yield: 6.83 gr. Melting point: 131°–132° C.

Elemental analysis: Calcd. C: 57.14%; H: 4.80%; O: 38.06%. Found C: 57.00%; H: 4.91%; O: 38.09%.

Example of Preparation of 2

(Compound 2)

11 gr of hydroquinone and 12.6 gr of glutaric anhydride were dissolved in 80 ml of dioxane. Then, to the solution was dropped 12 gr of triethylamine little by little with stirring.

After completion of the addition, the solution was stirred for about 2 hours at room temperature and then the solvent was distilled off under reduced pressure. To the residue was added 25 ml of water to dissolve it and then the solution was neutralized with hydrochloric acid and was subjected to extraction with ethyl acetate. The ethyl acetate layer was dried with $Na_2SO_4$ and the solvent was distilled off under reduced pressure. The residue was recrystallized from 40 ml of ethyl acetate.

Yield: 14.9 gr. Melting point: 156°–157.5° C.

Elemental analysis: Calcd. C: 58.92%; H: 5.40%; O: 35.68%. Found C: 58.71%; H: 5.51%; O: 35.78%.

The developing agent precursors used in this invention may be contained in silver halide emulsion layers of photographic elements or water permeable colloid layers, for example, overcoat layers or undercoat layers for the silver halide emulsion layers.

The developing agent precursors used in this invention may be added to silver halide emulsions or colloid dispersions by dissolving the precursors in a suitable solvent, e.g., water, methanol, etc. and then adding the solutions to the silver halide emulsions or colloid dispersions. Furthermore, the developing agent precursors of this invention may be dispersed with latex and then added to the silver halide emulsions or colloid dispersions by the method as shown in Japanese Patent Publication (Kokai) No. 137131/78.

When the developing agent precursors are incorporated into silver halide emulsions, the solutions of the precursors may be added at any stage of preparation of emulsions, but it is preferred to add them immediately before coating of the emulsions.

Concentration of the developing agent precursors of this invention may vary depending on the kind of the compounds and position of the compounds to be added in photographic elements.

When the developing agent precursors of this invention are to be added to silver halide emulsion layers, the amount of the precursors is generally 0.1–4 mols, preferably 0.25–2 mols per 1 mol of silver halide. When they are to be added to other colloid layers which contact with or are rendered in contact with silver halide emulsion layers at the time of development, the precursors may be used in a concentration somewhat higher than when added to the emulsion layers above.

Photographic elements where the developing agent precursors of this invention are contained in silver halide emulsion layers and/or other water permeable colloid layers can be developed with merely an alkaline activator bath after being exposed. The alkaline activator bath may be an aqueous solution of sodium hydroxide, potassium hydroxide, sodium carbonate, potassium carbonate and the like, but some other additives, for example, wetting agents, preservatives (e.g., sodium sulfite), surfactants, silver halide solvents (processing solution for diffusion transfer process), etc. may be added thereto.

Thus developed photographic elements can be stabilized by ordinary fixing or stabilizing solutions.

Silver halide emulsions to which this invention is applicable may be any kind of emulsion, for example, they may be spectrum sensitized or unsensitized emulsions, X-ray emulsions, infrared sensitive emulsions, etc. and furthermore they may be high sensitive negative emulsions and low sensitive positive emulsions and moreover may be orthochromatic or panchromatic type.

Various silver salts may be used as the light sensitive silver salts. For example, they are silver bromide, silver iodide, silver chloride or mixed silver halides (e.g., silver chlorobromide, silver iodobromide, etc.).

The silver halides can be dispersed in the ordinary hydrophilic colloids, e.g., gelatin, casein, polyvinyl alcohol, carboxymethylcellulose, etc., but gelatin is preferred.

Silver halide emulsions may be chemically or optically sensitized and they can be chemically sensitized by ripening in the presence of a small amount of sulfur-containing compounds (e.g., allylthiocyanate, allylthiourea, sodium thiosulfate, etc.).

The silver halide emulsions may also be sensitized with reducing agents (e.g., tin compounds as mentioned in French Pat. No. 1,146,955 and U.S. Pat. No. 2,487,850 and imino-aminomethane sulfinic acid compounds as mentioned in British Pat. No. 789,823) and a small amount of noble metals (e.g., gold, platinum, palladium, iridium, ruthenium and rhodium).

They may be also optically sensitized with cyanine dyes and merocyanine dyes.

Other additives such as development accelerators, anti-foggants, sensitizers, anti-oxidant, etc. may also be added to silver halide emulsion layers or other water permeable colloid layers.

The developing agent precursors according to this invention may be used in combination with other auxiliary developing agents which may be present in photographic elements or alkaline activator baths.

Representative examples of the auxiliary developing agents are 1-phenyl-3-pyrazolidinone and its derivatives (e.g., 1-phenyl-4-methyl-3-pyrazolidinone, 1-phenyl-4,4-dimethyl-3-pyrazolidinone, etc.).

Furthermore, the developing agent precursors according to this invention may also be used as tanning developer precursors.

That is, relief images can be produced by using photographic elements containing the developing agent precursors according to this invention and an alkali solution for activation of the development.

When said precursors of this invention are used in silver halide emulsion layers which can be hardened, said emulsions are very stable and are not hardened during storage and thus can be stored for a long time without hardening.

In the presence of aqueous alkalis, these precursors are easily decomposed to produce corresponding tanning developers and so there is no delay of development.

Thus obtained images have no stains, show no fogging and other defects and have desired sensitivity and gradation with usual developing time.

This invention will be illustrated by the following examples.

EXAMPLE 1

A silver iodochlorobromide gelatin emulsion having composition of silver bromide 65.5 mol%, silver chloride 34.0 mol% and silver iodide 0.5 mol% and having an average particle size of 0.45 μm was prepared by the neutral single jet method. After being subjected to physical ripening, the emulsion was desalted by water washing and gelatin was added thereto. Then, the emulsion was subjected to chemical ripening by adding sodium thiosulfate thereto. Thereafter, stabilizers, surfactants, hardeners were added to finish the emulsion.

Thus obtained gelatin-silver halide emulsion was divided into fifteen portions. To each of eight portions was added the developing agent precursors of this invention exemplified and listed hereinabove which are shown in Table II in an amount of 0.6 mol per 1 mol of silver halide. For comparison, to each of other six portions was added the developing agents and the known developing agent precursors as shown in Table I in an amount of 0.6 mol per 1 mol of silver halide (Comparison A).

To another one portion was added no developing agent nor precursor (Comparison B).

Each of thus obtained fifteen emulsions was coated at coverages of 2.5 g/m$^2$ of silver nitrate and 6.0 g/m$^2$ of gelatin on a photographic paper base both surfaces of which had been coated with polyethylene layer.

Thus obtained samples were warmed at 40° C. for 5 days.

TABLE I

| | Developing agents or precursors |
|---|---|
| Comparison A-1 | Catechol |
| Comparison A-2 | 2-benzoyloxyphenol |

TABLE I-continued

| | Developing agents or precursors |
|---|---|
| Comparison A-3 | Hydroquinone |
| Comparison A-4 | 4-benzoyloxyphenol |
| Comparison A-5 | 4-chloroacetyloxyphenol |
| Comparison A-6 | 1,4-diacetylhydroquinone |

A part of each sample was exposed through a step wedge, then developed with an alkaline activator solution having the following composition at 30° C. for 5 seconds, then subjected to stopping, fixing, water washing and drying. Photographic characteristics of the samples were measured.

Composition of alkaline activator solution

| | |
|---|---|
| Sodium hydroxide | 50.0 gr |
| Sodium sulfite | 50.0 gr |
| Potassium bromide | 2.0 gr |
| Water to make 1,000 ml | |

Another part of each sample was developed with said activator solution at 20° C. for 5 minutes without exposing them and state of fog was examined.

The results obtained are shown in Table II.

TABLE II

| Sample number | Precursors | Sensitivity ratio | Gamma | Maximum density | Fog |
|---|---|---|---|---|---|
| ① | The present compound 1 | 99.0 | 2.60 | 1.99 | 0.03 |
| ② | The present compound 4 | 99.2 | 2.59 | 1.99 | 0.03 |
| ③ | The present compound 7 | 98.0 | 2.62 | 1.98 | 0.03 |
| ④ | Comparison A-1 | 100.0 | 2.63 | 2.00 | 0.30 |
| ⑤ | Comparison A-2 | 25.0 | 0.89 | 0.98 | 0.08 |
| ⑥ | The present compound 2 | 99.2 | 2.50 | 1.95 | 0.03 |
| ⑦ | The present compound 10 | 99.1 | 2.49 | 1.95 | 0.03 |
| ⑧ | The present compound 11 | 98.5 | 2.48 | 1.96 | 0.03 |
| ⑨ | The present compound 12 | 98.9 | 2.46 | 1.96 | 0.03 |
| ⑩ | Comparison A-3 | 100 | 2.50 | 1.96 | 0.15 |
| ⑪ | Comparison A-4 | 20.3 | 0.70 | 0.81 | 0.04 |
| ⑫ | Comparison A-5 | 63.8 | 1.61 | 1.34 | 0.06 |
| ⑬ | The present compound 5 | 97.8 | 2.46 | 1.95 | 0.03 |
| ⑭ | Comparison A-6 | 33.6 | 0.75 | 0.95 | 0.04 |
| ⑮ | Comparison B (none) | 16.8 | 0.70 | 0.83 | 0.03 |

As is clear from the above results, the present compounds, namely, the developing agent precursors of this invention effectively liberate the corresponding developing agents only by dipping in the alkaline activator bath for a short period.

Furthermore, it will also be understood that the precursors of this invention caused less fog than when the corresponding developing agents were added and had no adverse effects on the photographic characteristics.

Note: The sensitivity ratio used in Table II means the ratio when sensitivity of the corresponding developing agents is taken as 100. That is, in the case of samples ①-③ and ⑤ the sensitivity of sample ④ (catechol) was taken as 100 and in the case of samples ⑥-⑨ and ⑪ - ⑮, the sensitivity of sample ⑩ (hydroquinone) was taken as 100.

EXAMPLE 2

A part of each of 15 samples obtained in Example 1 which had been warmed at 40° C. for 5 days was further warmed at 50° C. for 7 days at a relative humidity of 80% and developed with the same alkaline activator solution as used in Example 1 at 30° C. for 5 seconds without exposure and treated as in Example 1. Degree of stain due to oxidation of the developing agents was examined to find that samples ④ and ⑩ were severely stained while all of others were not stained.

EXAMPLE 3

A part of each sample obtained in Example 1 which was not warmed at 40° C. for 5 days was exposed through a line negative, developed with an alkali solution such as 10% solution of sodium carbonate at 20° C. for 3 minutes, then washed with a warm water of 50° C. to remove unexposed unhardened portions and then dried.

Excellent hardened images were obtained in samples 1 - 4 , 6 - 10 , 12 and 13 .

We claim:

1. In a photographic element suitable for permitting a developing agent precursor to form an —OH group in alkaline solution comprising a support having thereon at least one colloid layer including silver halide emulsion layer, the improvement comprising the incorporation of a hydroquinone or catechol silver halide developing agent precursor having at least one of the hydroxyl groups of hydroquinone or catechol in the form of the following general formula in said silver halide emulsion layer and/or other water permeable colloid layer:

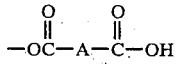

wherein A represents a divalent residue represented by the following general formula (III) or (IV):

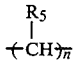

(III)

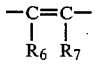

(IV)

wherein n is 2 or 3, $R_5$ represents a hydrogen atom, a lower alkyl group, a phenyl group, a halogen atom or an alkoxy group, $R_6$ and $R_7$ represent a hydrogen atom, a halogen atom, an alkyl group or a phenyl group and $R_6$ and $R_7$ taken together may form a benzene ring.

2. A photographic element according to claim 1, wherein the compound is selected from the following group of compounds:

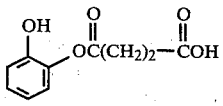

Compound 1

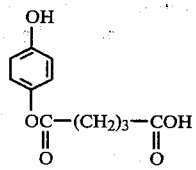

Compound 2

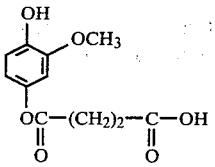

Compound 3

-continued

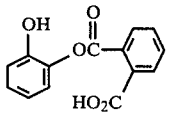

Compound 4

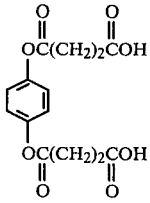

Compound 5

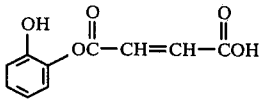

Compound 6

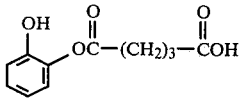

Compound 7

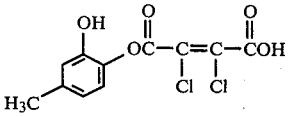

Compound 8

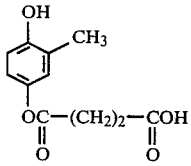

Compound 9

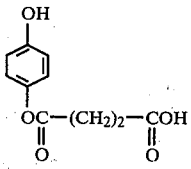

Compound 10

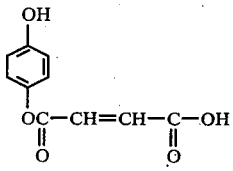

Compound 11

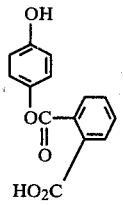

Compound 12

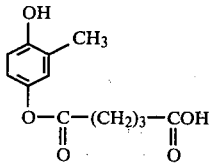

Compound 13

-continued

Compound 14

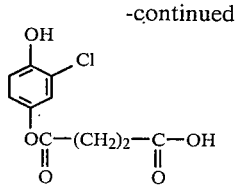

Compound 15

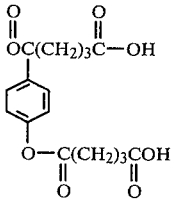

Compound 16

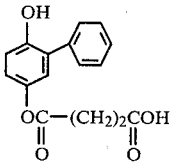

Compound 17

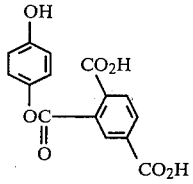

Compound 18

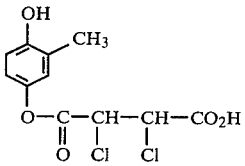

3. In a photographic element for black and white photography and suitable for permitting a developing agent precursor to form an —OH group in alkaline solution, said element comprising a support having thereon at least one colloid layer including silver halide emulsion layer, the improvement comprising the incorporation of a hydroquinone or catechol silver halide developing agent precursor having at least one of the hydroxyl groups of hydroquinone or catechol in the form of the following general formula in said silver halide emulsion layer and/or other water permeable colloid layer:

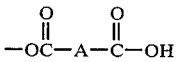

wherein A represents a divalent residue represented by the following general formula (III) or (IV):

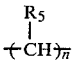

(III)

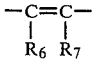

(IV)

wherein n is 2 or 3, $R_5$ represents a hydrogen atom, a lower alkyl group, a phenyl group, a halogen atom or an alkoxy group, $R_6$ and $R_7$ represent a hydrogen atom, a halogen atom, an alkyl group or a phenyl group and $R_6$ and $R_7$ taken together may form a benzene ring.

4. A photographic element according to claim 3 wherein the alkyl and alkoxy groups of $R_5$ and the alkyl group of $R_6$ and $R_7$ have 1 to 5 carbon atoms.

5. A photographic element according to claim 1, 3 or 4 wherein the precursor has the following general formula (I) or (II):

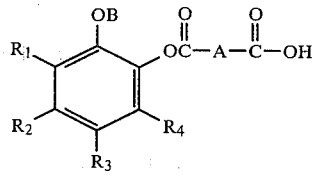

(I)

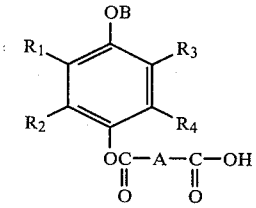

(II$ wherein $R_1$, $R_2$, $R_3$ and $R_4$ represent a hydrogen atom, an alkyl group, a phenyl group, a halogen atom or an alkoxy group, A represents a divalent residue represented by the following general formula (III) or (IV):

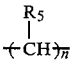

(III)

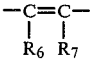

(IV)

wherein n is 2 or 3, $R_5$ represents a hydrogen atom, an alkyl group, a phenyl group, a halogen atom or an alkoxy group, $R_6$ and $R_7$ represent a hydrogen atom, a halogen atom, an alkyl group or a phenyl group and $R_6$ and $R_7$ taken together may form a benzene ring and B represents a hydrogen atom or

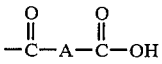

wherein A is the same divalent residue as defined above.

6. A photographic silver halide emulsion which contains a hydroquinone or catechol silver halide developing agent precursor having at least one of the hydroxyl groups of hydroquinone or catechol in the form of the following general formula:

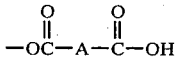

wherein A represents a divalent residue represented by the following general formula (III) or (IV):

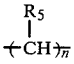

(III)

-continued $$-\underset{R_6}{\underset{|}{C}}=\underset{R_7}{\underset{|}{C}}- \quad \text{(IV)}$$

wherein n is 2 or 3, $R_5$ represents a hydrogen atom, a lower group, a phenyl group, a halogen atom or an alkoxy group, $R_6$ and $R_7$ represent a hydrogen atom, a halogen atom, an alkyl group or a phenyl group and $R_6$ and $R_7$ taken together may form a benzene ring, said emulsion being suitable for permitting the developing agent precursor to form an —OH group in alkaline solution.

7. A photographic silver halide emulsion for black and white photography which contains a hydroquinone or catechol silver halide developing agent precursor having at least one of the hydroxyl groups of hydroquinone or catechol in the form of the following general formula:

$$-\overset{O}{\overset{\|}{C}}-A-\overset{O}{\overset{\|}{C}}-OH$$

wherein A represents a divalent residue represented by the following general formula (III) or (IV):

$$\overset{R_5}{\overset{|}{(CH)_n}} \quad \text{(III)}$$

$$-\underset{R_6}{\underset{|}{C}}=\underset{R_7}{\underset{|}{C}}- \quad \text{(IV)}$$

wherein n is 2 or 3, $R_5$ represents a hydrogen atom, a lower alkyl group, a phenyl group, a halogen atom or an alkoxy group, $R_6$ and $R_7$ represent a hydrogen atom, a halogen atom, an alkyl group or a phenyl group and $R_6$ and $R_7$ taken together may form a benzene ring, said emulsion being suitable for permitting the developing agent precursor to form an —OH group in alkaline solution.

8. A photographic silver halide emulsion according to claim 7 wherein the alkyl and alkoxy groups of $R_5$ and the alkyl group of $R_6$ and $R_7$ have 1 to 5 carbon atoms.

9. A photographic silver halide emulsion according to claim 6, 7 or 8 wherein the precursor has the following general formula (I) or (II):

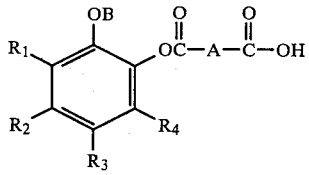

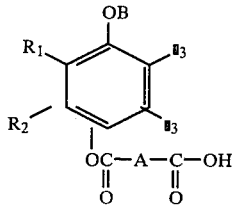

wherein $R_1$, $R_2$, $R_3$ and $R_4$ represent a hydrogen atom, an alkyl group, a phenyl group, a halogen atom or alkoxy group, A represents a divalent residue represented by the following general formula (III) or (IV):

$$\overset{R_5}{\overset{|}{(CH)_n}} \quad \text{(III)}$$

$$-\underset{R_6}{\underset{|}{C}}=\underset{R_7}{\underset{|}{C}}- \quad \text{(IV)}$$

wherein n is 2 or 3, $R_5$ represents a hydrogen atom, an alkyl group, a phenyl group, a halogen atom or an alkoxy group, $R_6$ and $R_7$ represent a hydrogen atom, a halogen atom, alkyl group or a phenyl group and $R_6$ and $R_7$ taken together may form a benzene ring and B represents a hydrogen atom or $$-\overset{O}{\overset{\|}{C}}-A-\overset{O}{\overset{\|}{C}}-OH$$

wherein A is the same divalent residue as defined above.

10. A photographic silver halide emulsion according to claim 9 wherein content of the precursor is 0.1–4 mols per mol of the silver halide.

11. A photographic silver halide emulsion according to claim 9 wherein the content of the precursor is 0.75 to 2 mols per mole of the silver halide.

12. A photographic process for making an image which comprises imagewise exposing a photographic silver halide element containing a hydroquinone or catechol silver halide developing agent precursor having at least one of the hydroxyl groups of hydroquinone or catechol in the form of the following general formula and thereafter processing it with an alkaline solution to form an —OH group:

$$-\overset{O}{\overset{\|}{C}}-A-\overset{O}{\overset{\|}{C}}-OH$$

wherein A represents a divalent residue represented by the following formula (III) or (IV):

$$\overset{R_5}{\overset{|}{(CH)_n}} \quad \text{(III)}$$

$$-\underset{R_6}{\underset{|}{C}}=\underset{R_7}{\underset{|}{C}}- \quad \text{(IV)}$$

wherein n is 2 or 3, $R_5$ represents a hydrogen atom, an alkyl group, a phenyl group, a halogen atom or an alkoxy group, $R_6$ and $R_7$ represent a hydrogen atom, a halogen atom, an alkyl group or a phenyl group and $R_6$ and $R_7$ taken together may form a benzene ring.

13. A photographic process for making an image which comprises imagewise exposing a photographic silver halide element for black and white photography containing a hydroquinone or catechol silver halide developing agent precursor having at least one of the hydroxyl groups of hydroquinone or catechol in the form of the following general formula and thereafter processing it with an alkaline developing solution to form an —OH group:

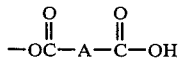

wherein A represents a divalent residue represented by the following general formula (III) or (IV):

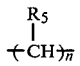

(III)

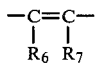

(IV)

wherein n is 2 or 3, $R_5$ represents a hydrogen atom, an alkyl group, a phenyl group, a halogen atom or an alkoxy group, $R_6$ and $R_7$ represent a hydrogen atom, a halogen atom, an alkyl group or a phenyl group and $R_6$ and $R_7$ taken together may form a benzene ring.

14. A photographic process according to claim 13 wherein the alkyl and alkoxy groups of $R_5$ and the alkyl group of $R_6$ and $R_7$ have 1 to 5 carbon atoms.

15. A photographic process according to claim 12, 13 or 14 wherein the precursor has the following general formula (I) or (II):

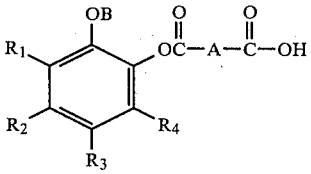

(I)

-continued

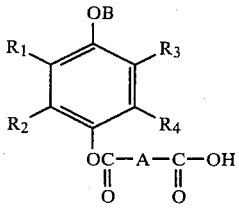

(II)

wherein $R_1$, $R_2$, $R_3$ and $R_4$ represent a hydrogen atom, an alkyl group, a phenyl group, a halogen atom or an alkoxy group, A represents a divalent residue represented by the following general formula (III) or (IV):

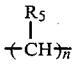

(III)

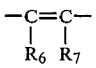

(IV)

wherein n is 2 or 3, $R_5$ represents a hydrogen atom, an alkyl group, a phenyl group, a halogen atom or an alkoxy group, $R_6$ and $R_7$ represent a hydrogen atom, a halogen atom, an alkyl group or a phenyl group and $R_6$ and $R_7$ taken together may form a benzene ring and B represents a hydrogen atom or

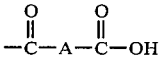

wherein A is the same divalent residue as defined above.

16. A photographic process according to claim 15 wherein the exposed element is processed with an alkaline activator bath.

* * * * *